US005431348A

United States Patent [19]

Orsolini et al.

[11] Patent Number: 5,431,348

[45] Date of Patent: Jul. 11, 1995

[54] ULTRACENTRIFUGAL DISINTEGRATOR AND ITS USE FOR THE CRYOCOMMINUTION OF HEAT SENSITIVE MATERIAL

[75] Inventors: Piero Orsolini; Frederic Heimgartner; Edith Heimgartner, all of Martigny, Switzerland

[73] Assignee: Debio Recherche Pharmaceutique SA, Martigny, Switzerland

[21] Appl. No.: 109,054

[22] Filed: Aug. 19, 1993

[30] Foreign Application Priority Data

Aug. 21, 1992 [CH] Switzerland ..... 2613/92

[51] Int. Cl.[6] ..... B02C 11/08; B02C 21/00

[52] U.S. Cl. ..... 241/23; 241/27; 241/46.017; 241/46.08; 241/46.17; 241/65; 241/74; 241/86.1; 241/DIG. 37

[58] Field of Search ..... 241/23, 27, 41, 46.017, 241/46.02, 46.08, 46.11, 46.17, 65, 74, 86, 86.1, 189.1, DIG. 37

[56] References Cited

U.S. PATENT DOCUMENTS

| | | | |
|---|---|---|---|
| 2,886,254 | 5/1959 | Rohlinger et al. . | |
| 2,919,862 | 1/1960 | Beike et al. . | |
| 3,386,670 | 6/1968 | Heger | 241/74 |
| 3,771,729 | 11/1973 | Frable . | |
| 3,965,267 | 6/1976 | Davis | 241/DIG. 37 X |
| 4,018,633 | 4/1977 | Holland | 241/DIG. 37 X |
| 4,023,734 | 5/1977 | Hervé et al. | 241/DIG. 37 X |
| 4,098,463 | 7/1978 | Lowry . | |
| 4,273,294 | 6/1981 | Hollely et al. | 241/DIG. 37 X |
| 4,304,076 | 7/1982 | Weitzen | 241/DIG. 37 X |
| 4,663,030 | 5/1987 | Chupka et al. | 241/74 X |

FOREIGN PATENT DOCUMENTS

| | | | |
|---|---|---|---|
| 0317935 | 5/1989 | European Pat. Off. . | |
| 2142523 | 1/1973 | France . | |
| 197811 | 11/1978 | United Kingdom | 241/DIG. 37 |
| 2073048 | 10/1981 | United Kingdom | 241/DIG. 37 |
| WO87/03951 | 7/1987 | WIPO . | |

OTHER PUBLICATIONS

"Cryogenic grinding technology for traditional Chinese herbal medicine", *Cryogenics*, vol. 31, Feb. 1991, By S. Li et al., pp. 136–137.

*Primary Examiner*—Timothy V. Eley
*Attorney, Agent, or Firm*—Young & Thompson

[57] ABSTRACT

The ultracentrifugal disintegrator includes a device for cooling the annular zone (7), extending from the outer face (8) of the rotor (4) to the inner face (9) of the sieve (5), by feeding a gaseous coolant to the upper part of the zone (7), vertically with respect to the zone (7). Such a disintegrator is used for the cryocomminution of heat sensitive material.

13 Claims, 4 Drawing Sheets

ULTRACENTRIFUGAL DISINTEGRATOR AND ITS USE FOR THE CRYOCOMMINUTION OF HEAT SENSITIVE MATERIAL

FIELD OF THE INVENTION

The invention is concerned with an ultracentrifugal disintegrator provided with a cooling device as well as with the use of such a disintegrator for the cryoeomminution of heat sensitive material.

BACKGROUND OF THE INVENTION

An ultracentrifugal disintegrator of the conventional type includes at least a housing equipped with a system for feeding the material to be comminuted, a motor-driven rotating member (rotor) with blades or pins, an annular sieve positioned around the rotor and a collector for the comminuted material.

In such an apparatus, the comminution of the selected material is carried out through impaction, collision and shearing action. The material arrives into the comminution chamber via the feeder funnel and is caught by the rotor turning at high speed and comminuted into minute particles in less than one second, between the rotor and the annular sieve. The material remains in the comminution chamber only until it reaches the fineness of particles required; under the effect of the centrifugal force, it traverses the annular sieve and reaches the collector.

This type of apparatus is available commercially and is particularly well adapted for grinding quite a variety of inorganic materials (clay, gypsum, limestone), plant materials (cellulose fibers, fodder, wood chips . . . ) or further synthetic materials such as resins and plastics.

In the case of heat sensitive materials being comminuted, whether they be natural or synthetic, this type of apparatus reaches rapidly its limits, and this even more so as the refrigeration modes proposed by the suppliers themselves prove ineffective in numerous cases. As a result, a progressive clogging of the openings of the sieve can occur by the softened or even the molten material, or even worse, the material being comminuted can undergo substantial denaturation. When active substances such as medieaments are processed, this poor control over the temperature conditions prevailing in the comminution chamber can lead to an irreversible alteration of said active substances. In numerous instances investigated, commercial ultracentrifugal disintegrators proved to be unusable.

OBJECTS OF THE INVENTION

The invention proposes a solution which is new, original and particularly effective for overcoming the problems associated with the eomminution of heat sensitive materials.

A further object of the invention is a cryocomminution process using such a disintegrator, as well as the product obtained through this process. In a particular version of said process designed roe medicamentous substances, a further object of the invention is the use of such a comminuted product in the preparation of injectable suspensions.

BRIEF DESCRIPTION OF THE DRAWINGS

The appended drawings illustrate the invention without however limiting its scope.

DETAILED DESCRIPTION OF THE INVENTION

Figure 1:
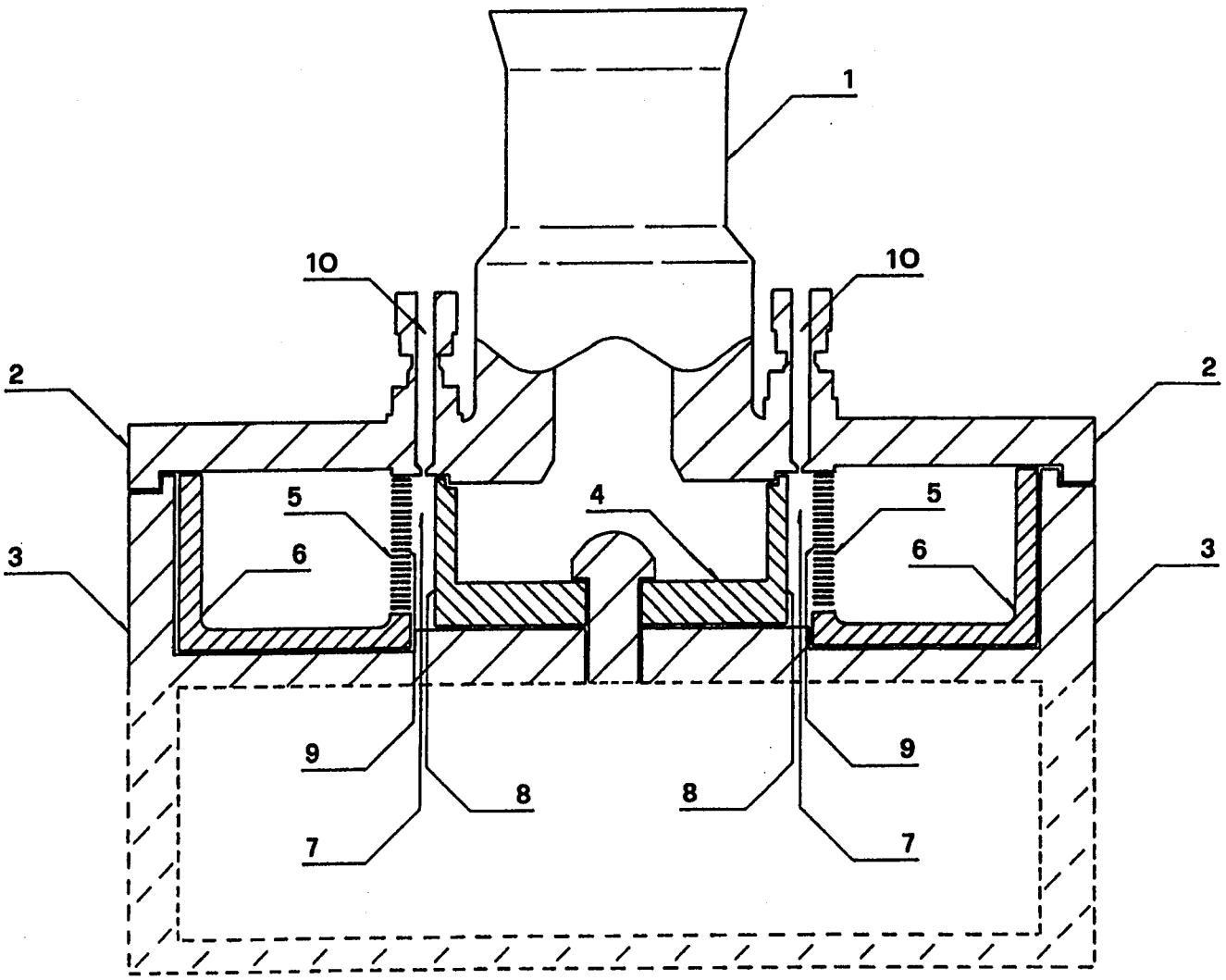
FIG. 1 is a diagrammatic cross-sectional view of certain components of an apparatus in accordance with the invention. In this figure, the true relative dimensions of the various constituent components of the apparatus are not respected.
Figure 3:
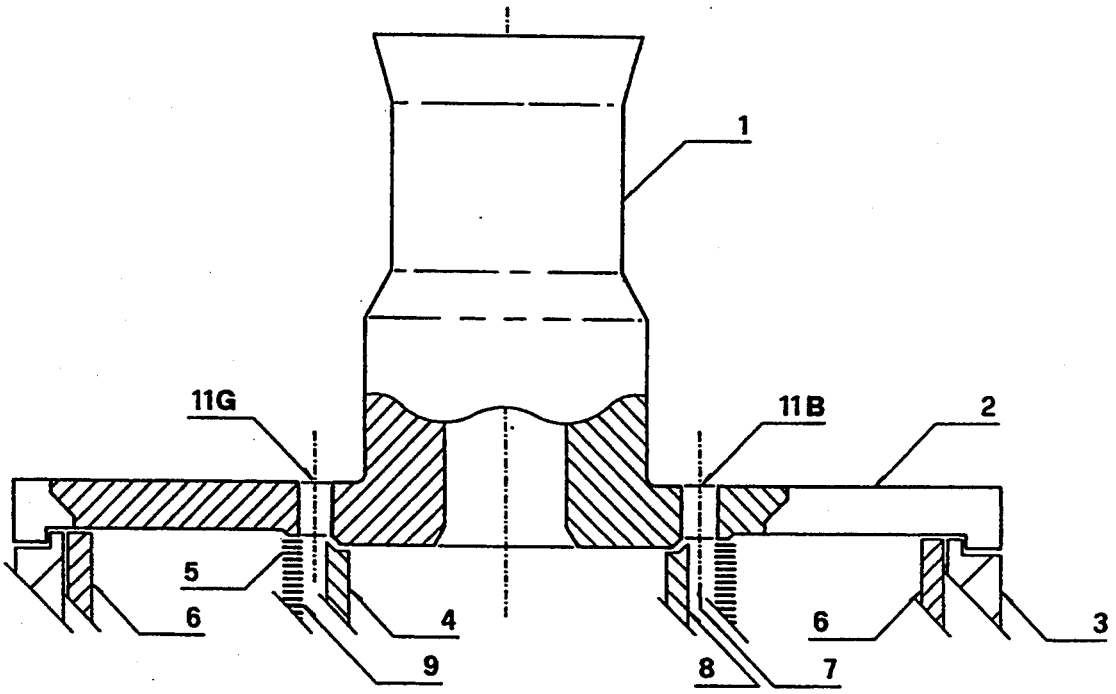
FIG. 3 is a side view of the component of FIG. 2.

In one embodiment of the invention, the ultracentrifugal disintegrator includes a feeder funnel 1 fastened to the upper part 2 of the chamber 2, 3, a rotor 4 arranged along the axis of the funnel 1 inside the chamber 2, 3, an annular sieve 5 arranged around the rotor 4 and a collector 6 for the eomminuted material, itself placed around the sieve 5, as illustrated in FIG. 1. According to the invention, the disintegrator includes a cooling device for the annular zone 7 extending from the outer face 8 of the rotor 4 to the inner face 9 of the sieve 5, which device introduces a gaseous coolant into the upper part of the zone 7, vertically with respect to said zone 7.

Figure 2:
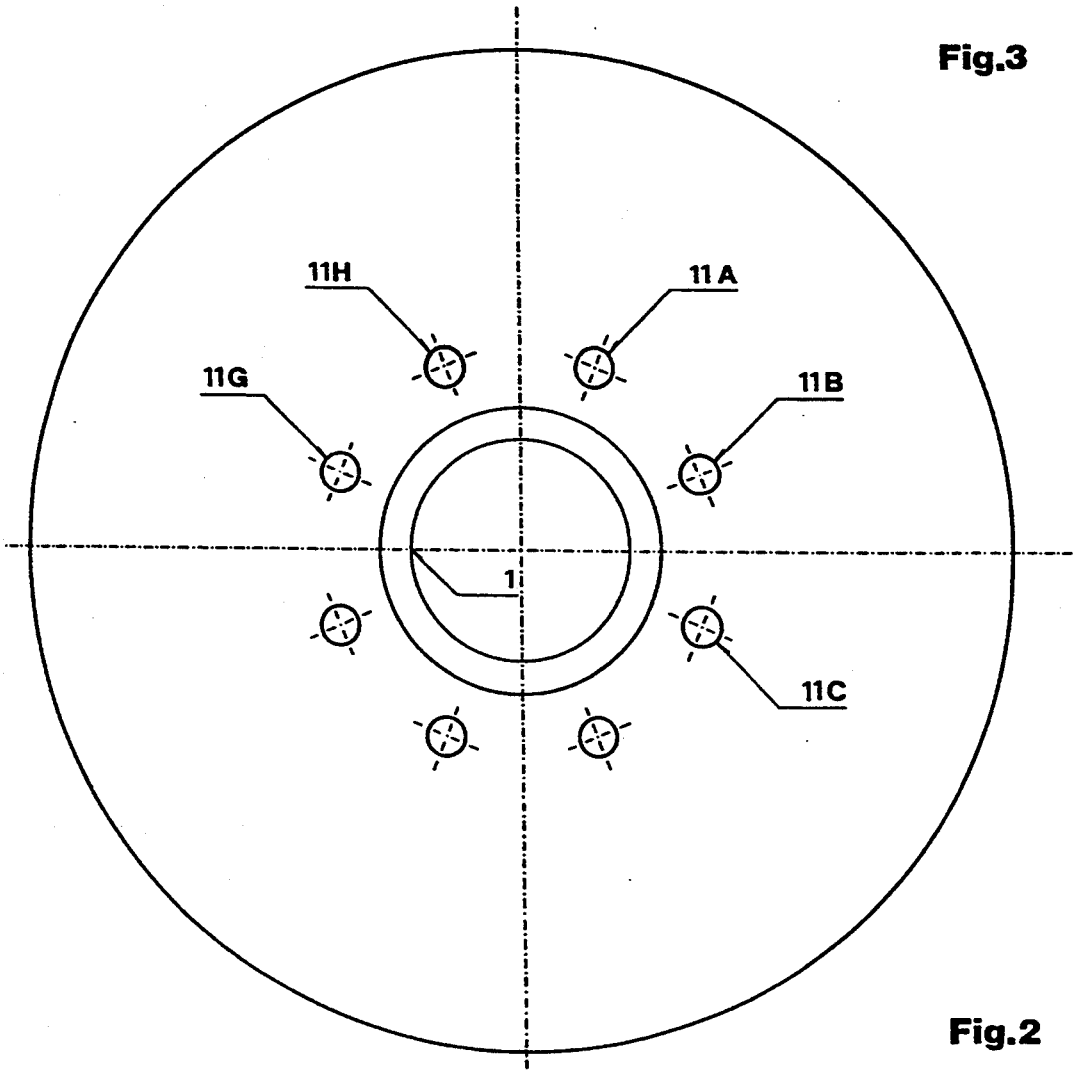
FIG. 2 is a top view of a component of an apparatus in accordance with the invention.

According to the invention, the cooling device consists of a nozzle assembly 10 arranged in a circle vertically with respect to zone 7. One can see in FIG. 2 for example, the circular arrangement of the orifices 11A, 11B, 11C, . . . in which are placed the actual nozzles. Such a circular arrangement seems to be the most favourable for achieving the effect desired, because of the need both to control the effect of the flow of gas on the path followed by the comminuted particles and to cool the mechanically active zones, in particular the blades or pins of rotor 4 and the annular sieve 5, in addition to the cooling of the comminuted material itself. In a preferred embodiment, the nozzles 10 will be arranged in a pattern which will be perfectly symmetrical, with the number of such nozzles being selected by the user as appropriate.

When using a disintegrator according to the invention, the cooling of the annular zone 7 extending from the outer face 8 of rotor 4 to the inner face 9 of annular sieve 5 is achieved by feeding liquefied gas through the nozzles 10 and the expansion of the gas exitLng from said nozzles. As can best be seen in FIG. 4, the liquefied gas is first fed from its supply source (not represented) via a conduit 12 to a manifold 13. The liquefied gas flows from the manifold 13 through as many connections as deemed necessary and through the conduits 14A, 14B, 14C, . . . to the nozzles 10. The assembling of these conduits can be carried out in a conventional manner, by using appropriate components, such as the metallic nuts and elbows 15, 16, 17, 18, for example.

When carrying out the cryocomminution of a heat sensitive material, the flow of liquefied gas is controlled in such a manner that after its expansion when exiting from the nozzles 10, the pressure prevailing inside the chamber 2, 3 be above atmospheric pressure. This particular mode of carrying out the process of the invention makes it possible to avoid the take up of moisture by the cold comminuted material from ambient air, which is bound to contain humidity under usual operating conditions.

The flow of liquefied gas, and accordingly the pressure of the gaseous coolant exiting from the nozzles 10, are also controlled, to reduce the turbulent flow of the comminuted particles, and in particular causing their outflow through the feeder funnel 1.

Concerning the liquefied gas as defined in the present invention, one will use preferably a gas which liquefies at a temperature below −100° C., such as for example air, nitrogen, helium or argon.

As discussed above, the pressure and the temperature prevailing inside the chamber 2, 3 are the factors which are the most important for obtaining the desired effects in the cryocomminution. Thus, the disintegrator according to the invention can advantageously be provided with a device for controlling said pressure. Said disintegrator can also be provided with a device for monitoring the temperature prevailing inside the chamber 2, 3, such as a temperature probe (not illustrated in the figures) placed for example in the vicinity of the annular zone 7.

In one particular embodiment, said disintegrator can also be provided with a device for feeding continuously the material to be comminuted, which can be coupled with the device for monitoring the temperature. It may prove useful to adjust the supply of material to be comminuted according to its nature, as well as to control the rotational speed of the rotor 4 and the temperature prevailing inside the chamber 2, 3.

Depending on circumstances, it may prove advantageous to cool the material before its comminution. More particularly, in the case of a heat sensitive material, such a cooling makes it more brittle, which in turn decreases the thermal effect of the mechanical collisions upon contact with the rotor and the sieve.

The use of a disintegrator such as described above is particularly recommended for the cryoeomminution of heat sensitive materials such as biodegradable polymers incorporating an active medicamentous substance. As examples of biodegradable polymers, one can mention polyesters such as polysuceinates, polylaetides, polyglycolides and eopolymers of lactic and glyeolic acids and, as examples of active medicamentous substances, one can mention polypeptides or pharmaceutically acceptable salts of polypeptides. Of course, this enumeration is not exhaustive.

In such cases, the particle size of the resulting material is perfectly well controlled and this material can be used for the preparation of injectable suspensions. Such suspensions make possible a controlled and sustained release of the medieamentous substances incorporated, for example of a polypeptide.

Clearly, those skilled in the art will be able to adapt in each case the use of the disintegrator of the invention to particular requirements.

EXAMPLE

Figure 4:
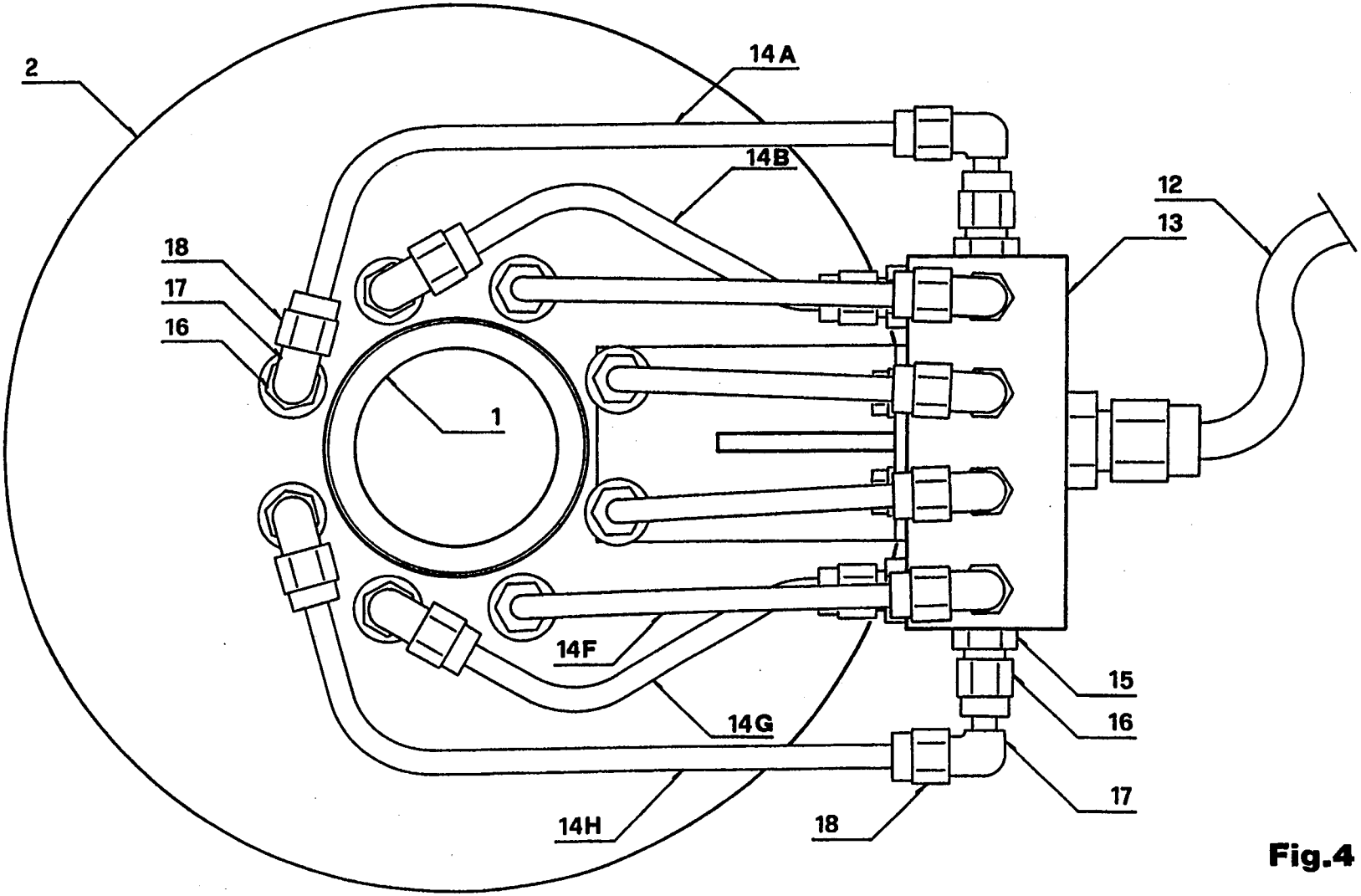
FIG. 4 is a top view of the upper part of an apparatus according to the invention.
Figure 5:
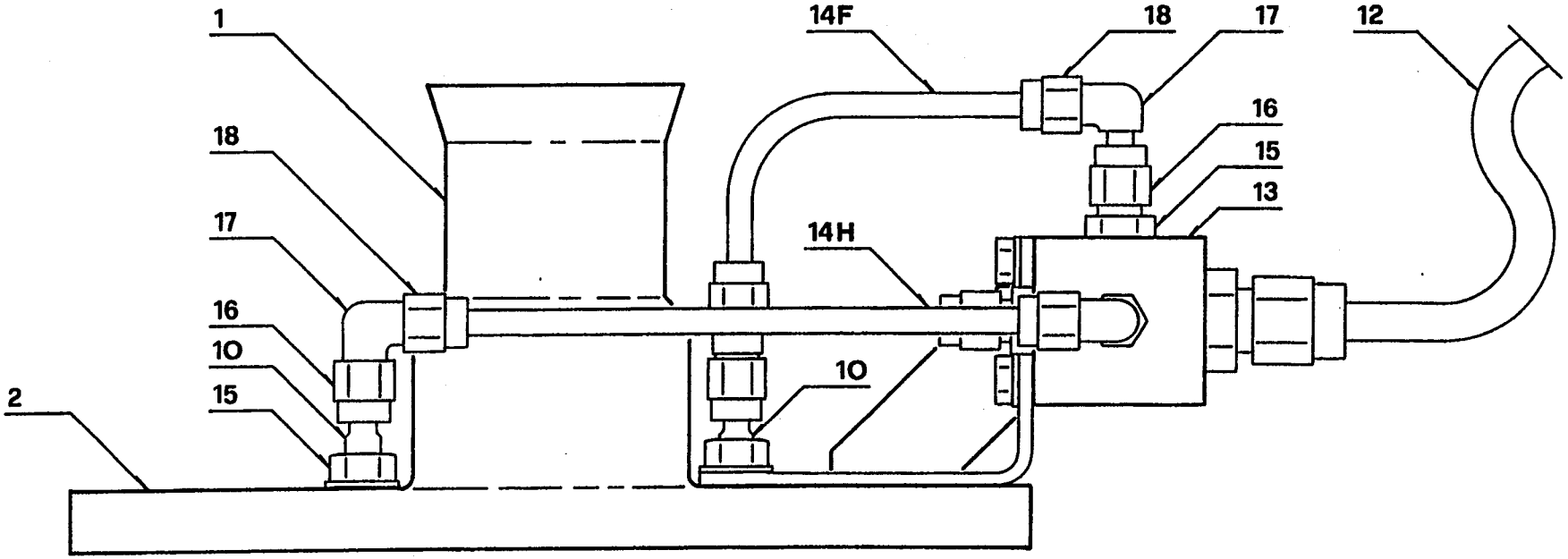
FIG. 5 is a side view of the component of FIG. 4.

An ultracentrifugal disintegrator of a conventional type was equipped with the cooling device illustrated in FIGS. 4 and 5: it carries 8 cooling nozzles arranged eireularly and regularly spaced, each one of them being connected in a conventional manner to the manifold. The nozzles are supplied with liquid nitrogen:

- material to be eomminuted: copolymer of lactic and of glycolic acids or PLGA (molar ratio 50:50; inherent viscosity 0.76 dl/g in HFIP) containing approximately 2% in weight of active peptide material;
- fed as short rods from 5 to 10 mm in length and 1.2 to 1.7 mm in diameter, cooled beforehand with liquid nitrogen;
- annular sieve with 80 micron openings.

15 g of said material were introduced inside the disintegrator at the rate of about 67 g/h. The rotational speed of the rotor was about 10,000 rpm. The eomminuted material was obtained with a yield of 79% and its average particle size was of 38–40 microns.

We claim:

1. In a process for the cryocomminution of heat sensitive material, comprising feeding the material to an ultracentrifugal disintegrator including a feeder funnel (1) fastened to the upper part (2) of a chamber (2, 3), a rotor (4) arranged along an axis of the funnel (1) inside the chamber (2, 3), an annular sieve (5) arranged around the rotor (4) and a collector (6) for the comminuted material surrounding the sieve (5); the improvement comprising supplying a gaseous coolant to the upper part of the annular zone (7) extending from the outer face (8) of the rotor (4) to the inner face (9) of the sieve (5), and causing said gaseous coolant to pass vertically downward through said zone between said rotor (4) and said sieve (5).

2. A process according to claim 1, wherein the pressure prevailing inside the chamber (2, 3) is maintained at a value above that of atmospheric pressure.

3. A process according to claim 1, wherein characterized in that the cooling of the annular zone (7) is obtained by feeding liquefied gas to the nozzles (10) and by the expansion of the liquefied gas exiting from said nozzles, vertically with respect to the zone (7).

4. A process according to claim 3, wherein the liquefied gas has a liquefaction temperature equal to or below −100° C.

5. A process according to claim 1, wherein the heat sensitive material fed to the disintegrator is cooled beforehand.

6. A process according to claim 1, wherein the heat sensitive material is a biodegradable polymeric material incorporating a medicamentous substance.

7. A process according to claim 6, wherein the biodegradable polymer is a polysuccinate, a polylactide, a polyglycolide or a copolymer of lactic and glycolic acids and in that the medicamentous substance is a polypeptide or a pharmaceutically acceptable salt of a polypeptide.

8. In an ultracentrifugal disintegrator including a feeder funnel (1) fastened to the upper part (2) of a chamber (2, 3), a rotor (4) arranged along an axis of the funnel (1) inside the chamber (2, 3), an annular sieve (5) arranged around the rotor (4) and a collector (6) for the comminuted material surrounding the sieve (5); the improvement which comprises a cooling device for an annular zone (7) extending from an outer face (8) of the rotor (4) to an inner face (9) of the sieve (5), which cooling device supplies a gaseous coolant to an upper part of the zone (7) to pass vertically downward throuqh said zone between said rotor (4) and said sieve (5).

9. A disintegrator according to claim 8, further comprising a nozzle assembly (10) arranged circularly and vertically with respect to the zone (7).

10. A disintegrator according to claim 8, further comprising a device for monitoring the temperature prevailing inside the chamber (2, 3).

11. A disintegrator according to claim 8, further comprising a device for supplying continuously the material to be comminuted.

12. A disintegrator according to claim 8, further comprising a continuously operating supply device for said gaseous coolant coupled with a device for monitoring the temperature prevailing inside the chamber (2, 3).

13. A disintegrator according to claim 8, further comprising a device for controlling the pressure prevailing inside the chamber (2, 3).

* * * * *